United States Patent [19]

Barrows et al.

[11] Patent Number: 4,523,798

[45] Date of Patent: Jun. 18, 1985

[54] CONNECTOR BLOCK

[75] Inventors: Kenneth C. Barrows, Liverpool; Raymond T. Divers, Camillus, both of N.Y.

[73] Assignee: Carrier Corporation, Syracuse, N.Y.

[21] Appl. No.: 548,379

[22] Filed: Nov. 3, 1983

[51] Int. Cl.[3] ..... H01R 13/436

[52] U.S. Cl. ..... 339/192 RL; 339/210 M

[58] Field of Search ..... 339/192 RL, 192 R, 191 R, 339/191 M, 191 S, 193 R, 210 R, 210 M

[56] References Cited

U.S. PATENT DOCUMENTS 3,601,780 8/1971 De Lyon et al. ..... 339/192 RL 3,850,496 11/1974 Hague ..... 339/192 RL

*Primary Examiner*—Neil Abrams

*Attorney, Agent, or Firm*—David J. Zobkiw

[57] ABSTRACT

A connector block operatively engages the pins of a terminal assembly in a frictional or other mechanical relationship such that the connector block is securely held in place. When held in place, the connector block overlies the pins such that they cannot be dislodged from the terminal assembly. Connectors located in the connector block provide frictional engagement with the pins while affording electrical access to the terminal assembly.

2 Claims, 3 Drawing Figures

CONNECTOR BLOCK

BACKGROUND OF THE INVENTION

The utilization of hermetically and semi-hermetically sealed motor-compressor units has become increasingly prevalent in recent years in refrigeration applications wherein the motor-compressor unit is employed to compress a refrigerant vapor. The compressor is generally driven by an electric motor, and the crankshaft of the compressor typically rotates at relatively high speeds. As is obvious, at relatively high operating speeds, proper lubrication of the crankshaft, journals, bearings and of other moving parts of the compressor is highly critical. Generally, lubricant such as oil is stored in a reservoir or sump in the casing of the motor-compressor unit, and an oil pump is employed to pump oil from the sump through the compressor to lubricate the moving parts thereof. Generally, when a hermetic or semi-hermetic motor-compressor unit is employed in a refrigeration circuit, the lubricating oil is miscible with the refrigerant vapor. A portion of the oil pumped through the compressor becomes entrained with the refrigerant passing therethrough, and the entrained oil circulates through the refrigeration circuit with the refrigerant.

A terminal assembly is provided to supply electric power through the casing of the hermetic compressor. The terminal assembly comprises a body member welded or otherwise secured to the compressor casing and has a plurality of conductor pins secured to and extending through the body member such that one end of each pin is located within the casing while the other end extends outside of the casing. Electrical insulating and sealing material such as glass or epoxy potting forms a hermetic seal between each pin and the body member. The internal end of each pin is connected in any suitable conventional manner to the electrical leads of the motor for driving the compressor. The external end of each pin is connected to a suitable source of power in any suitable conventional manner. Typically, a cover is provided over the external pins and their connections.

The diameters of the pins are so small, about one eighth inch, that the operating pressures acting on the internal ends of the pins produce maximum forces on the order of five pounds acting on each of the pins. However, if the glass or epoxy bond of one of the pins becomes broken or damaged, the pin with the damaged seal may be dislodged from the terminal assembly permitting rapid leakage of refrigerant and oil.

SUMMARY OF THE INVENTION

The present invention is directed to a connector block adapted to fit onto and mechanically engage the external spade terminations of a terminal assembly of a hermetic compressor and which provides flag connectors, remote from the spade terminations, for a unit wiring connection. The connector block overlies the external spade terminations of the pins of the terminal assembly such that they cannot be dislodged from the terminal.

It is an object of this invention to provide a connector block for attachment to a terminal assembly.

It is another object of this invention to provide a connector block with separate interfaces for the unit wiring connection and the external connections of a terminal assembly.

It is a further object of this invention to provide a connector block suitable for use with existing terminal assemblies without requiring changes in the terminal feedthrough, the unit wiring terminations or the method of and pattern of making the unit wiring connection.

It is an additional object of this invention to secure conductor pins in hermetic compressors.

It is a still further object of this invention to reduce or eliminate the possibility of a pin being dislodged from a terminal assembly by using the strength of the undamaged pins to hold the connector block and thereby the damaged pin in place. These objects, and others as will become apparent hereinafter, are accomplished by the present invention.

Basically, a connector block is secured to a terminal assembly through a friction or other mechanical engagement with the pins of the terminal assembly. The connector block overlies the pins so as to prevent the dislodging of a pin from the terminal assembly and provides an electrical connection between the pins and an external power source.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENT

Figures 1, 2, 3:
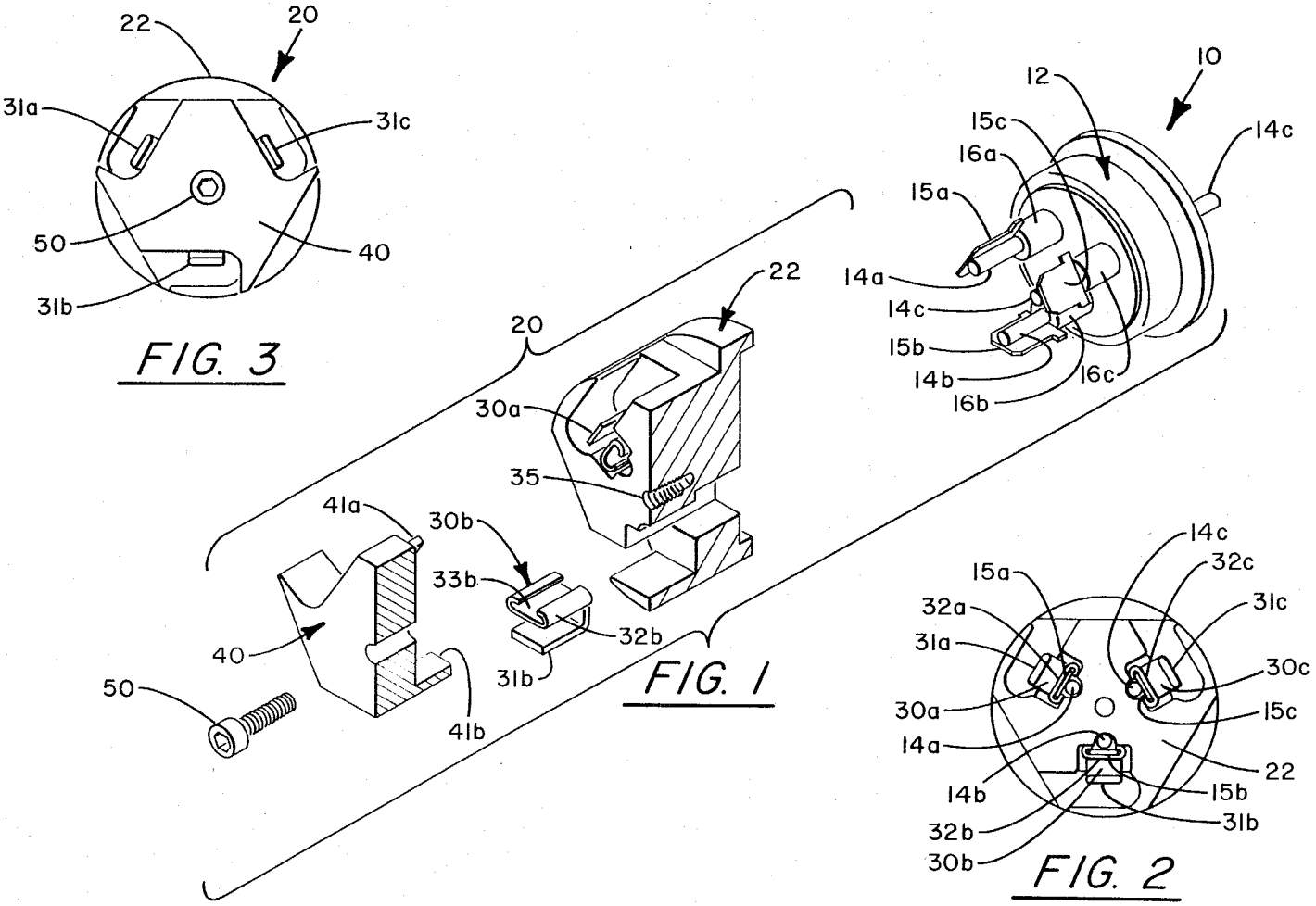
FIG. 1 is a partially sectioned, exploded view of a terminal assembly and connector block.
FIG. 2 is an end view of the connector block base installed on a terminal assembly.
FIG. 3 is an end view of the connector block.

In FIG. 1, the numeral 10 generally designates the terminal assembly and the numeral 20 generally designates the connector block. The terminal assembly 10 is of conventional construction and includes a body 12 which is welded or otherwise secured to a compressor casing (not illustrated) in a sealed relationship as is well known in the art. Three pins 14*a, b* and *c* extend through body 12 with the external ends of pins 14*a–c* having spade terminals 15*a–c,* respectively, soldered or otherwise suitably secured thereto. The pins 14*a–c* are secured to body 12 by a glass weld or epoxy 16*a–c,* or in any other suitable manner. Connector block 20 is made up of a base 22, three identical connectors 30 *a–c,* a cover 40 and a screw 50. As best shown in FIGS. 1 and 2, connector 30*b* is U-shaped and includes arms 31*b* and 32*b* connected by a bight. Arm 32*b* forms a slot 33*b* for frictionally receiving the spade terminal 15*b.*

Referring specifically to FIG. 2, it is readily apparent that when base 22 of connector block 20 is installed on terminal assembly 10, arms 32*a–c* of connectors 30*a–c* frictionally engage and become integral with spade terminals 15*a–c*, respectively, but, of themselves, offer no resistance to the dislodging of pins 14*a–c*. Cover 40 has a plurality of axial projections, with only 41*a* and *b* being illustrated, for engaging the bights of each of the connectors 30*a–c*, respectively, to thereby prevent the dislodging of the pins 14*a–c* and their integral connectors 30*a–c*. When cover 40 is in place, as illustrated in FIG. 3, it overlies pins 14*a–c* and connectors 30*a–c* such that only arms 31*a–c* of connectors 30*a–c* which are located radially outward of arms 32*a–c*, respectively, and cover 40, are exposed. Cover 40 is held in place by screw 50 which is threadably received in threaded bore 35 of base 22. Cover 40, in turn, holds connectors 30*a–c* in place so that base 22, connectors 30*a–c*, cover 40 and screw 50 form an integral unit. Frictional engagement between spade terminals 15*a–c* and the slots formed in arms 32*a–c* secure connector block 20 to terminal assembly 10. Thus, if one of the pins 14*a–c* has its glass or epoxy bond 16*a–c* broken and is forced against cover 40, screw 50 holds cover 40 attached to base 22 and base 22 is in turn held to terminal assembly 10 by the frictional engagement between the intact remaining pin(s) 14*a–c*, by their spade terminals 15*a–c*, and the corresponding slots in arms 32*a–c*.

Referring now to FIG. 3, when the assembled connector block 20 is coupled to terminal assembly 10, arms 31*a–c* serve as flag connectors and afford electrical access to the structure to which terminal assembly 10 is attached while cover 40 prevents the dislodging of pins 14*a–c*. Thus, the present invention eliminates the need for the uncovering of the pins 14*a–c* as long as connector block 20 is in place and the other pins are intact. Depending upon circumstances, one intact pin 14*a–c* may be capable of keeping connector block 20 in place. Also, as long as a pin is prevented from being dislodged, the rate of refrigerant and oil leakage is greatly reduced.

Although the present invention has been specifically illustrated and described in terms of a frictional engagement between the spade terminals and the connectors, other changes will occur to those skilled in the art. For example, other forms of mechanical engagement such as detents may be used in place of the frictional engagement. It is therefore intended that the scope of the present invention is to be limited only by the scope of the appended claims.

What is claimed is:

1. Electrical feedthrough structure for a hermetic compressor comprising:

(I) a terminal assembly adapted to be sealingly received in the casing of a hermetic compressor and including:

(a) a body;

(b) a plurality of pins sealably received in said body with each of said pins extending through said body and having first and second ends with said first end of each of said plurality of pins having first mechanical engaging means integral therewith;

(II) a connector block including:

(a) a base;

(b) a plurality of U-shaped connector means in said base and each including a first arm defining a second mechanical engaging means in the form of a slot adapted to coact with a corresponding one of said first mechanical engaging means by relative motion along an axial direction to mechanically secure said connector block to said terminal assembly and a second arm adapted to be connected to a source of electricity;

(c) cover means removably attached to said base and located with an outer edge radially inward of said second arms and overlying said first arms for securing said connector means in said base and for preventing said pins from being dislodged from said body but allowing electrical access along said axial direction to said second arms.

2. A connector block including:

a base;

a plurality of U-shaped connector means in said base and each including a first arm defining a slot means for mechanically engaging a conductor means by relative motion along an axial direction and a second arm adapted to be connected to a source of electricity; and cover means removably attached to said base and located with an outer edge radially inward of said second arms and overlying said first arms and coacting with said connector means for securing said connector means in said base and overlying said means for mechanically engaging a conductor means whereby the conductor means are prevented from being dislodged from said means for mechanically engaging a conductor means but allowing electrical access along said axial direction to said second arms.

* * * * *